US007328751B2

(12) United States Patent
Peterson et al.

(10) Patent No.: US 7,328,751 B2
(45) Date of Patent: Feb. 12, 2008

(54) POWDER OPERATED TOOL

(75) Inventors: Jennifer M. Peterson, Epping, NH (US); Gordon L. Steltzer, Kennebunkport, ME (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/248,481

(22) Filed: Oct. 12, 2005

(65) Prior Publication Data

US 2006/0090912 A1 May 4, 2006

Related U.S. Application Data

(60) Provisional application No. 60/623,730, filed on Oct. 28, 2004.

(51) Int. Cl.
*B25B 27/00* (2006.01)

(52) U.S. Cl. ..... 173/1; 227/10; 89/1.14; 89/47

(58) Field of Classification Search ..... 173/1; 227/9–11; 89/1.14, 1.34, 47
See application file for complete search history.

(56) References Cited

U.S. PATENT DOCUMENTS

| | | | | | |
|---|---|---|---|---|---|
| 2,770,194 | A | * | 11/1956 | Kopf et al. | 102/531 |
| 2,771,696 | A | * | 11/1956 | Kopf et al. | 42/106 |
| 3,060,435 | A | * | 10/1962 | Ivins et al. | 227/11 |
| 3,212,534 | A | | 10/1965 | Broske | 140/113 |
| 3,212,535 | A | * | 10/1965 | Broske | 140/113 |
| 3,257,499 | A | | 6/1966 | Broske | 174/94 |
| 3,292,363 | A | | 12/1966 | Wahl | 60/26.1 |
| 3,296,792 | A | | 1/1967 | Hedberg et al. | 60/26.1 |
| 3,343,294 | A | * | 9/1967 | Wahl | 42/106 |
| 3,473,718 | A | * | 10/1969 | Wackrow | 227/10 |
| 4,282,714 | A | * | 8/1981 | Fiocchi | 60/632 |
| 4,722,189 | A | | 2/1988 | Center | 60/635 |
| 4,905,603 | A | | 3/1990 | McBain | 102/530 |
| 4,945,730 | A | * | 8/1990 | Laney | 60/635 |
| 5,005,485 | A | | 4/1991 | Woo et al. | 102/531 |
| 5,337,566 | A | | 8/1994 | Lomastro et al. | 60/632 |
| 5,388,499 | A | | 2/1995 | Szyndlar | 89/1.14 |
| 5,533,254 | A | | 7/1996 | Gallo et al. | 29/750 |

(Continued)

FOREIGN PATENT DOCUMENTS

BR MU-8100185 1 U 10/2002

(Continued)

OTHER PUBLICATIONS

1. Instruction Manual, KF-001 Tool, Kron Instrumentos Electricos LTDA, 16 Pages.

(Continued)

*Primary Examiner*—Stephen F. Gerrity
(74) *Attorney, Agent, or Firm*—Harrington & Smith, PC

(57) ABSTRACT

A powder operated tool including a frame, a tool body and a reusable combined cartridge holder and ram rear end receiver. The frame includes an anvil section. The tool body is adjustably connected to the frame. The tool body comprises a ram, and a breech assembly connected to a rear end of the tool body. The breech assembly includes a striker, a breech pad and a firing pin. The reusable combined cartridge holder and ram rear end receiver is removably connected to the tool body.

19 Claims, 3 Drawing Sheets

U.S. PATENT DOCUMENTS

| | | | | |
|---|---|---|---|---|
| 5,657,919 | A * | 8/1997 | Berry et al. | 227/10 |
| 5,785,229 | A | 7/1998 | Franzini | 227/10 |
| 6,062,455 | A * | 5/2000 | Giannuzzi et al. | 227/10 |
| 6,085,958 | A * | 7/2000 | Kersten | 227/10 |

FOREIGN PATENT DOCUMENTS

| | | | |
|---|---|---|---|
| BR | PI-0106296-4 | A | 9/2003 |
| BR | PI-0204929-5 | A | 9/2003 |
| WO | WO9936230 | * | 7/1999 |

OTHER PUBLICATIONS

2. Photographs of Kron KF-001 Tool and Cardridge Holder, 3 pages.

* cited by examiner

POWDER OPERATED TOOL

CROSS REFERENCE TO RELATED APPLICATION

This application claims the benefit under 35 U.S.C. §119 (e) of U.S. provisional patent application No. 60/623,730 filed Oct. 28, 2004 which is hereby incorporated by reference in its entirety.

BACKGROUND OF THE INVENTION

1. Field of the Invention

The invention relates to a powder operated tool and, more particularly, to a tool having a removable and reusable cartridge holder and ram rear end receiver.

2. Brief Description of Prior Developments

U.S. Pat. No. 4,722,189, which is hereby incorporated by reference in its entirety, discloses an explosively-operated tool. A disposable cartridge is used with the tool. The cartridge has a case, a powder cell, a powder cell bushing and a piston. The bushing holds the powder cell. After firing, the piston might extend out of the front of the casing making the casing hard to remove from the tool. In addition, the piston must be removed to remove the spent powder cell and insert a new powder cell, and the piston replaced in the casing before the assembly can be reused in a tool. This can be time consuming.

A similar cartridge is disclosed in U.S. Pat. No. 5,005,485 which is also hereby incorporated by reference in its entirety. In this patent a plastic bushing holds the powder cell. The bushing deforms after firing. After firing this conventional assembly in a tool, the entire assembly is removed from the tool. A removal tool is required to remove the bushing and spent powder cell such that the casing can be reused. After firing, the piston might extend out of the front of the casing making the casing hard to remove from the tool. In addition, the piston must be removed to remove the spent powder cell and bushing and insert a new powder cell and bushing, and the piston replaced in the casing before the assembly can be reused in a tool. This can be time consuming.

There is a desire to provide a system for use in an explosively-operated tool which can removably hold a cartridge or powder cell, such that the spent or used cartridge can be easily removed and the casing be reused with a new cartridge or powder cell.

SUMMARY OF THE INVENTION

In accordance with one aspect of the invention, a powder operated tool is provided including a frame, a tool body and a reusable combined cartridge holder and ram rear end receiver. The frame includes an anvil section. The tool body is adjustably connected to the frame. The tool body comprises a ram, and a breech assembly connected to a rear end of the tool body. The breech assembly includes a striker, a breech pad and a firing pin. The reusable combined cartridge holder and ram rear end receiver is removably connected to the tool body.

In accordance with another aspect of the invention, a powder operated tool reusable combined cartridge holder and ram rear end receiver is provided comprising a rear end flange proximate a rear end of the combined cartridge holder and ram rear end receiver; a cartridge receiving seat extending through the rear end; and a ram receiving channel at a front end of the combined cartridge holder and ram rear end receiver. The ram receiving channel comprises an interior ledge at a rear end of the ram receiving channel. The rear end flange is sized and shaped to move inside a flange receiving area of a tool body of a powder operated tool to allow the combined cartridge holder and ram rear end receiver to longitudinally move in the tool body when a ram of the tool contacts the interior ledge at the rear end of the ram receiving channel and pushes the combined cartridge holder and ram rear end receiver rearward in the tool body.

In accordance with one method of the invention, a method of using a powder operated tool is provided comprising inserting a powder cartridge into a reusable combined cartridge holder and ram rear end receiver, wherein the reusable combined cartridge holder and ram rear end receiver is a one-piece metal member; inserting the reusable combined cartridge holder and ram rear end receiver and attached powder cartridge into a tool body of a powder operated tool, wherein the reusable combined cartridge holder and ram rear end receiver is biased in a forward position in the tool body; locating a rear end of a ram of the powder operated tool into a front end of the reusable combined cartridge holder and ram rear end receiver; moving the ram relative to the tool body to push the reusable combined cartridge holder and ram rear end receiver into a rearward position in the tool body; striking the cartridge with a firing pin, wherein gases from the cartridge move through the reusable combined cartridge holder and ram rear end receiver and push the ram forward; removing the reusable combined cartridge holder and ram rear end receiver from the tool body; removing the powder cartridge from the reusable combined cartridge holder and ram rear end receiver and inserting a new powder cartridge into the reusable combined cartridge holder and ram rear end receiver; and inserting the reusable combined cartridge holder and ram rear end receiver and attached new powder cartridge into the tool body.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
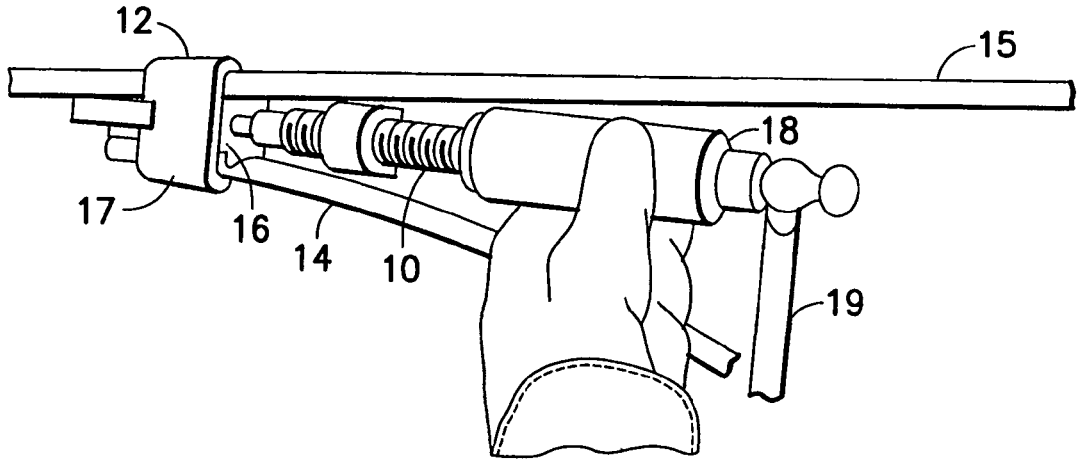
FIG. 1 is a perspective view showing a tool in use for installing an electrical connector.

Referring to FIG. 1, there is shown a perspective view of a tool 10 incorporating features of the invention being used to install an electrical connector 12. Although the invention will be described with reference to the exemplary embodiment shown in the drawings, it should be understood that the invention can be embodied in many alternate forms of embodiments. In addition, any suitable size, shape or type of elements or materials could be used.

The tool 10 is used for connecting a branch or tap wire 14 to a main powder line 15. The connector 12 includes a wedge 16 and a C-shaped sleeve 17. The tool 10 uses a powder cartridge to drive the wedge 16 into the sleeve 17 sandwiching the wire 14 and line 15 against opposite ends of the sleeve 17. The tool is fired by a user striking the rear end 18 of the tool 10 with a hand-held hammer 19.

Figure 2:
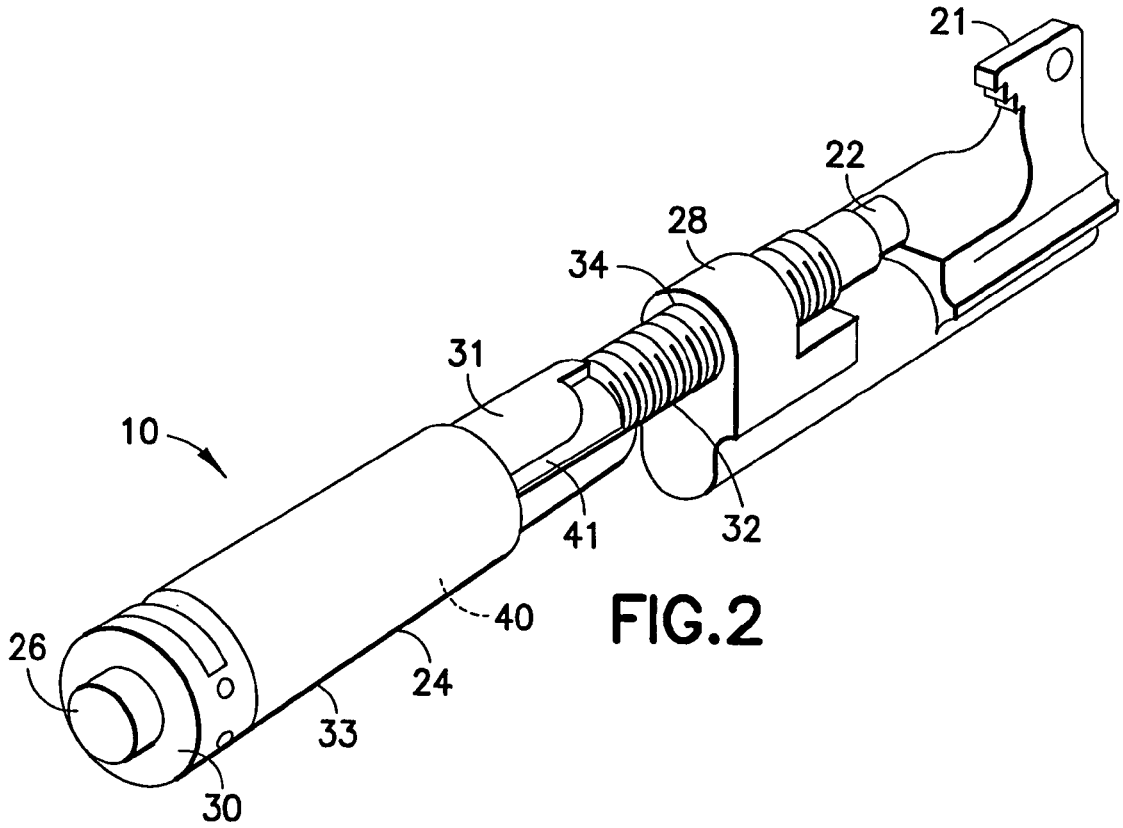
FIG. 2 is a perspective view of the connecting tool shown in FIG. 1 incorporating features of the invention.

Referring also to FIG. 2, there is shown an enlarged perspective view of the tool 10. The tool 10 is a hammer initiated powder actuated connecting tool. The tool 10 includes a frame and a tool body 24. The frame comprises an anvil section 21. The tool body 24 is adjustably connected to the anvil section. The tool body 24 is fitted through a support sleeve 28 at an end of the anvil section to position the powder ram 22 along the longitudinal axis of the tool. The tool body 24 comprises the ram 22 which is adapted to push against the wedge 16 to wedge the two cables 14, 15 into the shell 17 with the explosively powdered ram driving the wedge into its final position.

The tool body 24 includes a main section 31, a movable outer section 33, and a breech assembly 30. The main section 31 has a threaded section 32 inserted into the support sleeve 28 for adjustment of the tool body 24 with respect to the anvil section by means of a threaded connection 34. This adjustable connection can be used for advancing and retracting the powder ram 22 relative to the opposite side of the anvil section for engagement with the connector. The main section 31 is threaded along its forward surface at threaded section 32. The main section 31 includes a longitudinal axial bore for slidably receiving the powder ram 22 through its muzzle. The main section 31 also defines a firing chamber 40 for receiving components proximate its breech end as further described below. The components are loaded through a selectively closable side window in the outer section 33 and loaded axially into the rear end of the main section 31, which is located inside the movable outer section 33.

The main section 31 accommodates the firing chamber 40 which lies along the longitudinal axis of the tool. The main section 31 is generally cylindrical and includes at its front outer surface a slot 41 having longitudinally and circumferentially extending segments for receiving and guiding the movable outer section 33. The movable outer section 33 is slidably fitted over the main section 31 for loading, firing, and extracting the components in the firing chamber and for disarming the tool whenever it is removed from an unfinished connection without the cartridge being detonated.

Figure 3:
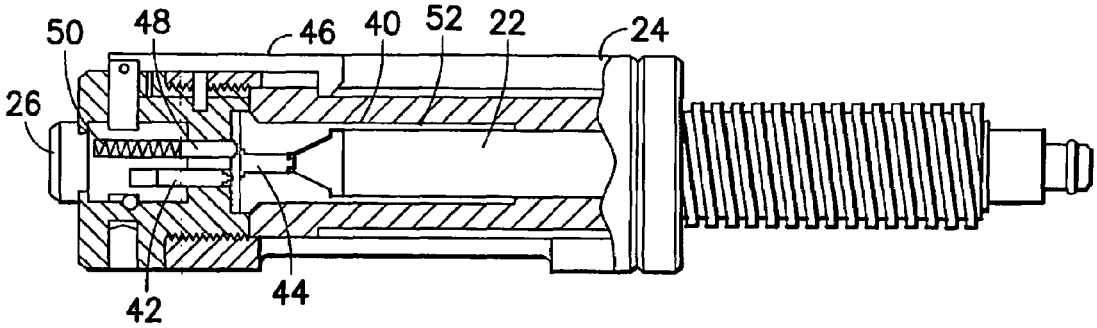
FIG. 3 is a partial cross sectional view of a tool body of the tool shown in FIG. 2.
Figure 4:
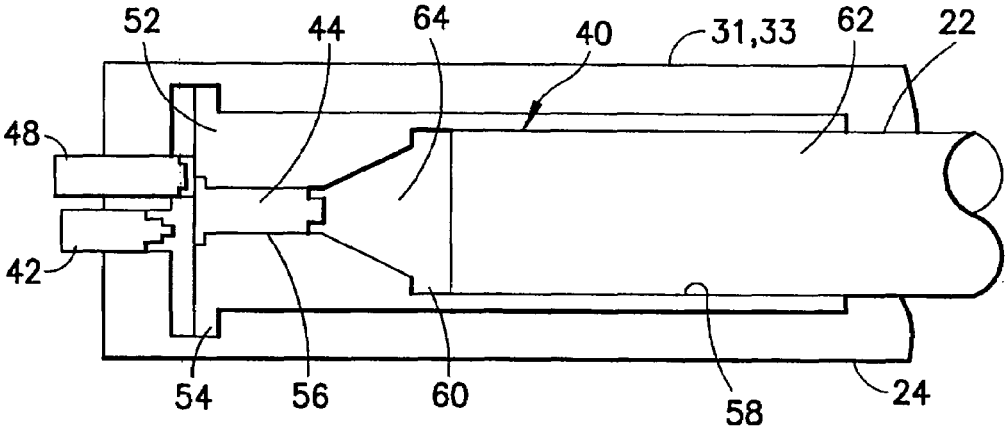
FIG. 4 is a diagram showing initial loading of a cartridge and a cartridge holder into the tool body shown in FIG. 3.

The movable outer section 33 is generally cylindrical with a knurled outer surface, and a window or breech opening for inserting components into the firing chamber 40. The breech assembly 30 is at the rear end of the tool body 24. In particular, the breech assembly 30 is on the outer moveable section 33. The breech assembly includes the striker 26. Referring also to FIGS. 3 and 4, the striker 26 is adapted to be hit by the hand-held hammer 19 (see FIG. 1) causing a firing pin 42 of the breech assembly 30 to strike a cartridge 44 inside the firing chamber 40. The breech assembly 30 also includes a safety latch 46 and a breech pad 48. The breech pad 48 is biased forward by a spring 50.

The tool 10 also comprises a removable and reusable combined cartridge holder and ram rear end receiver 52, further referred to herein as a "case". The case 52 is preferably comprised of metal, such as stainless steel, for example. The case 52 comprises a rear end flange 54, a cartridge receiving seat 56, ram receiving channel 58, and an interior ledge 60 at the rear end of the ram receiving channel 58. In an alternate embodiment the rear end flange might not be provided.

The stainless steel reusable booster case is provided that takes the place of a plastic case and plastic bushing and piston used in a conventional assembly, such as shown in U.S. Pat. Nos. 4,722,189 and 5,005,485. Thus, the case 52 is adapted to accomplish the function of three members in a conventional assembly with only one member; the single case member.

Figure 5:
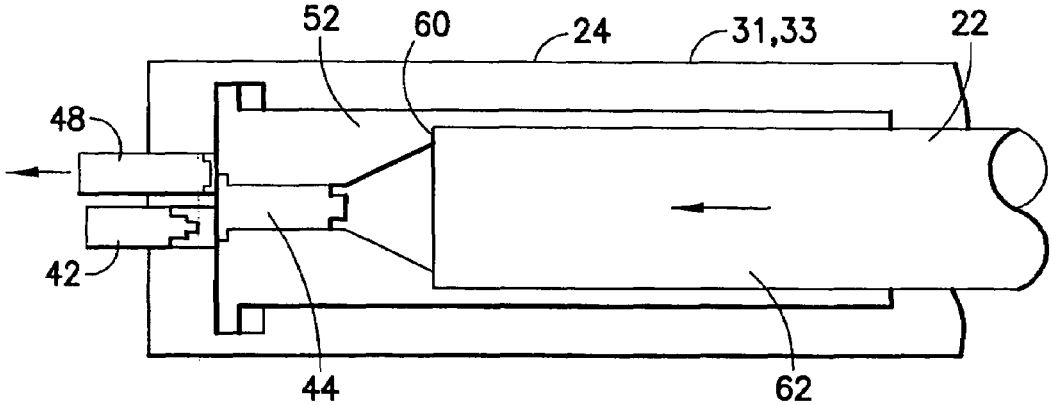
FIG. 5 is a diagram similar to FIG. 4 showing the powder ram loading the cartridge holder into its firing position.

The flange 54 on the metallic case 52 provides an extraction surface, similar to the rear flange on the prior art plastic case. Yet, the flange 54 on the metallic case 52 is thinner than the rear flange on the prior art plastic case. Thus, the flange 54 has the ability to move away from the firing pin 42 when the tool 10 is not ready as shown in FIG. 4. The case 52 is able to move close to the firing pin 42 when the tool is ready for firing as shown in FIG. 5. This additional safety feature is controlled through the movement of the case 52, unlike the prior art where the safety feature is controlled through the movement of the bushing as described in U.S. Pat. No. 4,722,189.

As seen in FIG. 4, the case 52 generally comprises a cartridge receiving seat 56, a ram receiving channel 58 and a gas expansion area 64 between the front of the seat 56 and the rear of the channel 58. The gas expansion area 64 has a general truncated cone shape to funnel or direct expanding gases from a fired cartridge against the rear end of the ram 22. In an alternate embodiment the gas expansion area might not be provided. The seat 56 is sized and shaped to removably receive the powder cartridge 44 from the rear end of the case 52. After the cartridge 44 is fired, the spent cartridge is removed in a reverse direction from the rear end of the case 52. The ram receiving channel 58 is sized and shaped to removably, slidably receive the rear end of the ram 22 through an open front end of the channel. The channel 58 has a suitably long length, and the exterior surface of the ram 22 and the interior surface of the channel 58 make a close fit with each other such that when the cartridge 44 is fired the expanding gases do not easily pass out of the case 52 between the case and the ram. The close tolerance between the case and the ram do not significantly hinder movement of the ram by the expanding gases after the cartridge is fired.

Referring particularly to FIGS. 4-8, a cartridge or powder cell 44 is inserted into the seat 56 of the case 52. The case 52 is then inserted into the base section 24 and the outer section 33 is moved to a closed position. Thus, the case 52 and attached cartridge 44 are placed in the firing chamber 40 and the movable outer section is closed and locked in position. When the outer section 33 is closed, the safety latch 46 allows movement of the striker 26. Inside the firing chamber 40, the breech pad 48 applies a force to the case, forcing it and the cartridge away from the firing pin. The case's thin flange 54 allows for this movement.

A connector sleeve, wedge and two cables (see FIG. 1) are located and positioned at the anvil section 21. The tool body 24 is rotated by the operator relative to the anvil section 21. This causes the threads of the main section 31 and the support sleeve 28 to move the tool body 24 towards the anvil section 21. The operator stops rotating the base section 24 when the anvil section 21 and front end of ram 22 sandwich the connector sleeve, conductors, and wedge therebetween.

Figure 6:
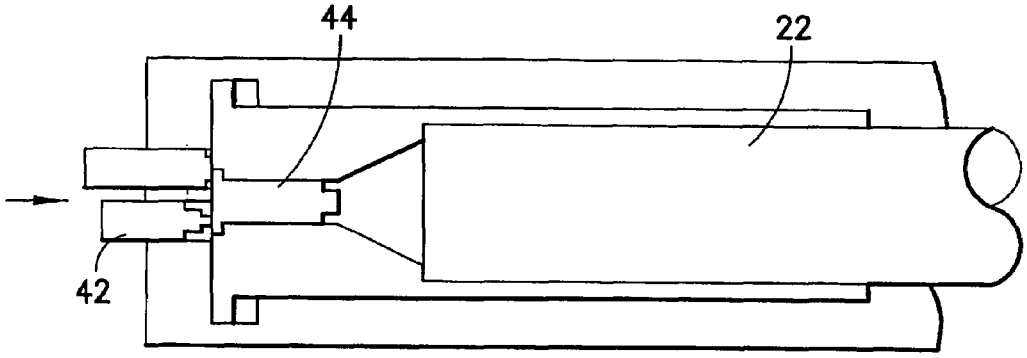
FIG. 6 is a diagram similar to FIG. 5 showing actuation of the firing pin.
Figure 7:
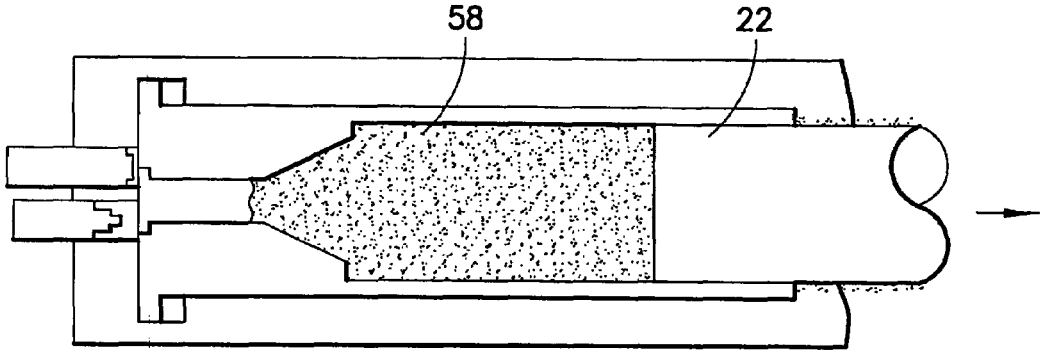
FIG. 7 is a diagram similar to FIG. 6 showing movement of the ram due to firing of the cartridge.
Figure 8:
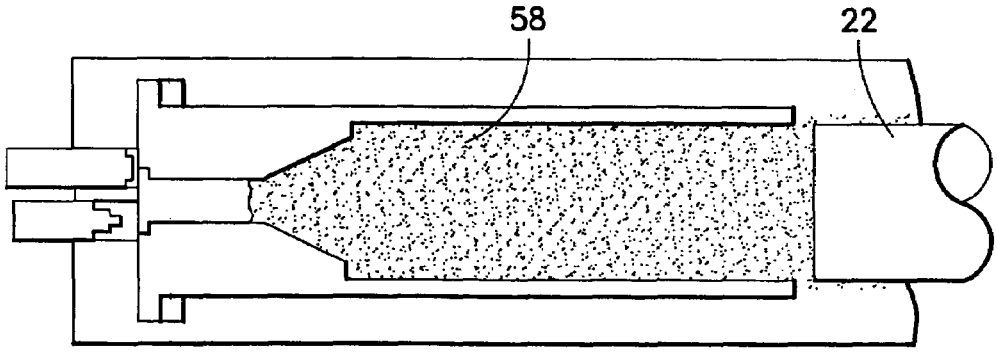
FIG. 8 is a diagram similar to FIG. 7 showing extraction of the powder ram out of the front end of the cartridge holder and release of gases.

As the ram 22 of the tool body 24 contacts the wedge 16 and the tool body 24 is continued to be moved forward, the rear end of the ram (i.e. the metallic piston section 62) contacts the ledge 60 as shown in FIG. 5 and pushes the case 52 rearward. The breech pad 48 is moved rearward by the case 52 to properly position the rear end of the cartridge in a position for subsequent striking by the firing pin 42. The operator then merely strikes the striker 26 with a hand held tool, such as the hand-held hammer 19. As seen in FIG. 6, this causes the firing pin 42 to ignite a primer of the cartridge to thereby fire the cartridge. As seen in FIG. 7, the gases from the cartridge 44 move into the ram receiving channel 58 and push against the rear end of the ram 22 to thereby drive the ram 22 forward towards the anvil section 21. The tight tolerance between the ram and the case minimizes the escape of gases from the channel 58 and, thus, ensures most of the force is spent on moving the ram.

The force exerted by the ram 22 is sufficient to drive the wedge into the connector sleeve with the cables therebetween in a very tight electrical and mechanical connection. Correspondingly, the force exerted by the connector sleeve, wedge and cables, by their connection, to the ram 22 causes the ram 22 to be stopped from moving forward when the connection is complete. Once the connection is completed, the base section 24 is unscrewed from the anvil 21, thus backing the ram off of the connector. The tool 10 is then removed from the completed connection. The movable outer section 33 is rotated and moved relative to the main section 31, to allow the case 52 and the spent cartridge 44 to be removed from the tool. The cartridge 44 is then removed from the case 52 and the case 52 is available for reuse.

In an alternate embodiment, the invention could be used in a tool other than a wedge connector attachment tool. With the invention, the plastic piston used in the prior art or a metal piston has not been provided. Instead, the rear end of the ram 22 forms an integral metallic piston section 62. This metallic piston section could be integrally formed with the rest of the ram, or could be a separate member fixedly attached at the rear end of the ram, such as by being press fit on the rear end of the ram. This design means that only the case 52 and spent cartridge 44 are removed from the tool after firing, and only the spent cartridge 44 is removed from the case when a new cartridge is to be inserted into the case. Thus no extra steps or removal tools are required to remove a bushing or piston as needed in the conventional assemblies.

Designs were tested in a firing fixture using a crusher test procedure with a crude prototype of the tool. This test measured the thickness of cylindrical copper crushers after they have been compressed by the firing of a powder compression tool. The metallic reusable design yielded good results. All but one test fell within the specified range and the one that did not pass was very close to passing. This leads one to believe that the reusable metallic case idea is feasible when implemented in a production tool rather than a crude prototype tool.

This design was created to be used with a standard industrial blank 0.27 caliber cartridge; where the powder level of the cartridge corresponds to the size of the connector. This was to control the experiment. However, in alternate embodiments, the invention could be adapted to incorporate use of any suitable size of cartridge; standard or specifically designed.

With the invention, a metallic case can be provided for use in a powder actuated tool, wherein the rear end has a feature to seat an industrial powder cartridge and the other front end has a ram-receiving channel. The flange located on the rear end of case can aid in extraction of the case from tool (similar to the flange in prior art described above), but also allows for movement of the case in the firing chamber. An interior ledge 60 located in the ram receiving channel can provide a surface for the ram to apply force to the case, and the case can apply this force to breech pad.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A powder operated tool comprising:

a frame comprising an anvil section;

a tool body adjustably connected to the frame, wherein the tool body comprises a ram, and a breech assembly connected to a rear end of the tool body, wherein the breech assembly comprises a striker, a breech pad and a firing pin; and a reusable combined cartridge holder and ram rear end receiver removably connected to the tool body, wherein the reusable combined cartridge holder and ram rear end receiver comprises a ram receiving channel, a gas expansion area, and a cartridge receiving seat, wherein the gas expansion area extends between the cartridge receiving seat and a rain contact ledge of the ram receiving channel, and wherein the ram contact ledge is integral with the reusable combined cartridge holder and ram rear end receiver.

2. A powder operated tool as in claim 1 wherein the ram receiving channel extends from the ram contact ledge to a front end of the reusable combined cartridge holder and ram rear end receiver.

3. A powder operated tool as in claim 1 wherein the ram contact ledge in the ram receiving channel faces forward and is adapted to contact a rear side of the ram.

4. A powder operated tool as in claim 1 wherein the cartridge receiving seat has an entrance at a rear end of the reusable combined cartridge holder and ram rear end receiver and a front end at the gas expansion area.

5. A powder operated tool as in claim 1 wherein the reusable combined cartridge holder and ram rear end receiver is a one-piece metal member.

6. A powder operated tool as in claim 5 wherein the reusable combined cartridge holder and ram rear end receiver comprises a rear end flange which is sized and shaped to move inside a flange receiving area of the tool body to allow the combined cartridge holder and ram rear end receiver to longitudinally move in the tool body.

7. A powder operated tool as in claim 1 wherein the reusable combined cartridge holder and ram rear end receiver is longitudinally movable in the tool body between a forward position and a rearward position, and wherein the breech pad is spring biased against a rear side of the reusable combined cartridge holder and ram rear end receiver to bias the reusable combined cartridge holder and ram rear end receiver in the forward position.

8. A powder operated tool as in claim 1 wherein the gas expansion area comprises a general truncated cone shape.

9. A powder operated tool as in claim 1 wherein the reusable combined cartridge holder and ram rear end receiver comprises a one-piece case with a cartridge receiving seat sized and shaped to removably receive a powder cartridge therein into and out of the rear end.

10. A powder operated tool as in claim 9 wherein the cartridge receiving seat is sized and shaped to receive and stationarily hold a powder cartridge therein without any other member therebetween.

11. A powder operated tool as in claim 10 wherein a ram receiving channel of the case is sized and shaped to receive a rear end of the ram directly opposite the powder cartridge in the cartridge receiving seat without any other member therebetween.

12. A powder operated tool reusable combined cartridge holder and ram rear end receiver comprising:

a rear end flange proximate a rear end of the combined cartridge holder and ram rear end receiver;

a cartridge receiving seat extending through the rear end; and a ram receiving channel at a front end of the combined cartridge holder and ram rear end receiver, the ram receiving channel comprising an interior ledge at a rear end of the ram receiving channel, and wherein the interior ledge is integral with the combined cartridge holder and ram rear end receiver, wherein the rear end flange is sized and shaped to move inside a flange receiving area of a tool body of a powder operated tool to allow the combined cartridge holder and ram rear end receiver to longitudinally move in the tool body from a spring biased non-firing position to a firing position when a ram of the tool contacts the interior ledge at the rear end of the ram receiving channel and pushes the combined cartridge holder and ram rear end receiver rearward in the tool body.

13. A powder operated tool reusable combined cartridge holder and ram rear end receiver as in claim 12 wherein the reusable combined cartridge holder and ram rear end receiver is a one-piece metal member.

14. A powder operated tool reusable combined cartridge holder and ram rear end receiver as in claim 13 further comprising a gas expansion area between the cartridge receiving seat and the ram receiving channel, wherein the gas expansion area comprises a general truncated cone shape.

15. A powder operated tool reusable combined cartridge holder and ram rear end receiver as in claim 12 comprising a one-piece case wherein the cartridge receiving seat is sized and shaped to removably receive a powder cartridge therein into and out of the rear end.

16. A powder operated tool reusable combined cartridge holder and ram rear end receiver as in claim 12 wherein the cartridge receiving seat is sized and shaped to receive and stationarily hold a powder cartridge therein without any other member therebetween.

17. A powder operated tool reusable combined cartridge holder and ram rear end receiver as in claim 12 wherein the ram receiving channel is sized and shaped to receive a rear end of the ram directly opposite a powder cartridge in the cartridge receiving seat without any member therebetween.

18. A powder operated tool comprising:

a frame comprising an anvil section;

a tool body adjustably connected to the frame, wherein the tool body comprises a ram, and a breech assembly connected to a rear end of the tool body, wherein the breech assembly comprises a striker, a breech pad and a firing pin; and a powder operated tool reusable combined cartridge holder and ram rear end receiver as in claim 12 removably connected to the tool body.

19. A method of using a powder operated tool comprising:

inserting a powder cartridge into a reusable combined cartridge holder and ram rear end receiver, wherein the reusable combined cartridge holder and ram rear end receiver is a one-piece metal member;

inserting the reusable combined cartridge holder and ram rear end receiver and attached powder cartridge into a tool body of a powder operated tool, wherein the reusable combined cartridge holder and ram rear end receiver is biased in a forward position in the tool body;

locating a rear end of a ram of the powder operated tool into a front end of the reusable combined cartridge holder and ram rear end receiver;

moving the ram relative to the tool body to contact an interior ledge and push the reusable combined cartridge holder and ram rear end receiver into a rearward position in the tool body against a spring bias, wherein the interior ledge is integral with the reusable combined cartridge holder and ram rear end receiver;

striking the cartridge with a firing pin, wherein gases from the cartridge move through the reusable combined cartridge holder and ram rear end receiver and push the ram forward;

removing the reusable combined cartridge holder and ram rear end receiver from the tool body;

removing the powder cartridge from the reusable combined cartridge holder and ram rear end receiver and inserting a new powder cartridge into the reusable combined cartridge holder and ram rear end receiver; and inserting the reusable combined cartridge holder and ram rear end receiver and attached new powder cartridge into the tool body.

* * * * *

UNITED STATES PATENT AND TRADEMARK OFFICE

CERTIFICATE OF CORRECTION

PATENT NO. : 7,328,751 B2
APPLICATION NO. : 11/248481
DATED : February 12, 2008
INVENTOR(S) : Peterson et al.

It is certified that error appears in the above-identified patent and that said Letters Patent is hereby corrected as shown below:

In Claim 1: Column 6, line 24 delete “rain” and insert --ram--

Signed and Sealed this

Twenty-seventh Day of May, 2008

JON W. DUDAS
*Director of the United States Patent and Trademark Office*